US005493367A

United States Patent [19]

Altrieth, III et al.

[11] Patent Number: 5,493,367

[45] Date of Patent: Feb. 20, 1996

[54] REPRODUCTION APPARATUS AND METHOD FOR CORRECTLY ORIENTING PRINCIPAL COPIES AND SUPPLEMENTAL COPIES

[75] Inventors: Frederick E. Altrieth, III, Scottsville; Alfred Gonnella, Greece, both of N.Y.

[73] Assignee: Eastman Kodak Company, Rochester, N.Y.

[21] Appl. No.: 362,724

[22] Filed: Dec. 23, 1994

[51] Int. Cl.[6] ..... G03G 15/00

[52] U.S. Cl. ..... 355/210; 355/200; 355/202; 355/313; 355/323; 355/325; 355/244; 270/17

[58] Field of Search ..... 355/325, 200, 355/202, 210, 244, 313, 314, 323, 322, 321, 204; 270/15, 17, 51, 95; 271/314, 287, 288, 298; 358/450

[56] References Cited

U.S. PATENT DOCUMENTS

| | | | |
|---|---|---|---|
| 4,169,674 | 10/1979 | Russel . | |
| 4,201,464 | 5/1980 | Botte et al. . | |
| 4,211,483 | 7/1980 | Hannigan et al. . | |
| 4,285,591 | 8/1981 | Botte et al. . | |
| 4,674,862 | 6/1987 | Abuyama . | |
| 4,887,128 | 12/1989 | Jamali et al. . | |
| 4,961,092 | 10/1990 | Rabb et al. | 355/325 X |
| 5,065,181 | 11/1991 | Ito | 355/202 |
| 5,070,372 | 12/1991 | Randall | 355/328 X |
| 5,079,598 | 1/1992 | Kaneko et al. | 355/313 X |
| 5,081,494 | 1/1992 | Reed et al. . | |
| 5,081,596 | 1/1992 | Vincent et al. | 395/104 |
| 5,085,418 | 2/1992 | Rapkin et al. . | |
| 5,316,279 | 5/1994 | Corona et al. | 355/325 X |
| 5,321,467 | 6/1994 | Tanaka et al. | 355/202 |
| 5,331,375 | 7/1994 | Ito | 355/202 |

*Primary Examiner*—Matthew S. Smith
*Attorney, Agent, or Firm*—Norman Rushefsky

[57] ABSTRACT

A method and apparatus for assembling copy sets of a first or principal copy job including a plural number of identical copies of an original document of one or more pages with a supplemental copy job including a like plural number of copy sheets. The first copy job is reproduced in either a first mode wherein the copies are made of the original document last page first to first page last copy order or a second mode wherein copies are made of the original document first page first to last page last copy order. Copy sheets of each copied page of the original document are sorted into a like number of collating bins wherein the copy sheets are stored in collated order. In response to commands entered by the user specifying the number of copies to be made of the original document and the selection of the first mode or the second mode, the feeding of copy sheets is repetitively operated for storing copy sheets respectively in the bins in the first or second order in which the pages of the original document are reproduced. In response to selection of the first mode for the first copy job copies of information associated with a supplemental copy and/or print job are successively made on copy sheets and positioned in a first orientation in each of the bins consistent with respect to the pages of each copy made of the original document therein. In response to selection of the second mode for the first copy job copies of information associated with a supplemental copy and/or print job on copy sheets are successively made and positioned in a second orientation in each of the bins consistent with respect to the pages of each copy made of the original document therein. There is thus provided consistency in orientation of the two jobs in the bins.

9 Claims, 3 Drawing Sheets

REPRODUCTION APPARATUS AND METHOD FOR CORRECTLY ORIENTING PRINCIPAL COPIES AND SUPPLEMENTAL COPIES

BACKGROUND OF THE INVENTION

1. Field of the Invention

The present invention relates to reproduction apparatus and methods, and more specifically, to improvements in merging a supplemental print job of electronically written variable information or supplemental copy job with a previous copy job of multiple collated copies of a document copied using a recirculating document feeder or a document positioner.

2. Brief Description of the Prior Art

Electrophotographic or electrostatographic reproduction apparatus such as xerographics copiers may be described as image forming apparatus which is provided with image information on a document and reproduces it on a copy sheet. Such high speed electrophotographic reproduction apparatus as the Kodak® 2100 copier/duplicator is capable of being programmed by an operator for printing or copying a first job followed by or in conjunction with a job supplement selection so that a resulting set of copies includes the merged together main and supplemental job. The merged together jobs are assembled in the bins of a collator.

In the Kodak® 2100 copier, a feature referred to as VIEW (variable information electronically written) may be employed together with a data base of variable information data in order to customize copies made from the original document. For example, 20 copies of a ten page document may be optically reproduced as a copy job. A job supplement job then may be reproduced using a cover sheet original that is optically copied while each copy is printed with a different address. Thus when the copy job and job supplement job are merged in the sorter each copy will contain a custom addressed cover letter. Alternatively, the VIEW feature may be employed to electronically print an entire separate cover sheet for each copy having particular variable information reproduced thereon. In this sense, the copying of the original document to form multiple collated copy sets constitutes the primary copy job, and the electronic printing of the variable information employing the VIEW feature may be characterized as a job supplement or job-plus operation. Commonly assigned U.S. Pat. No. 4,887,128, describes one manner in which VIEW data is merged into and printed on a cover sheet of one page of a print job so that each copy is customized with individual addressee information read from a data base in a patch creation mode. It is also desirable at times to be able to merge together in a proper order, the main and supplemental copy jobs made from optical copying of two separate original documents.

The exposure of a multisheet original document for optical copying normally takes place on an exposure platen, wherein the sheets of the original document are serially presented to the exposure platen in a predetermined exposure position either manually or by operation of an automatic document positioner feeder or by a recirculating document feeder. Where the sorter is elected for collation, multiple copies are made of each sheet of a multisheet document original as each sheet comes to be is supported on the exposure platen. The multiple copies of each sheet are transported to a collator where they are directed to separate bins where optimally, the copy sheets are stacked in the same order as the pages of the original document.

The automatic document positioner feeder typically automatically transports each sheet of the multisheet original document manually placed in a document feeding position in a sequence onto the exposure platen where the sheet is successively exposed once for each copy to be made. Thus if N copies are to be made where N is an integer greater than one, the sheet is exposed at least N times. After the requisite number of exposures of each sheet of the document are made onto the charged photosensitive member, the sheet is transported to a document take-up tray. The document positioner feeder normally operates by feeding document sheets to the platen in an order established by the operator and typically an operator will feed sheets from the top first and the bottom last. The associated collator drops each copy sheet in the order made in respective collator bins. In order for the copies to be in collated order in each bin, the copies are placed face down in the bin since the page order of making copies using the document positioner is usually from first to last (simplex case).

As noted above, an original document may also be copied by manually placing document sheets onto the exposure platen. For example, U.S. Pat. No. 4,674,862 describes a relatively simple photocopier having a feeder that may be moved out of the way in order to position either a thick book or a very thin and fragile sheet of paper onto the exposure platen for exposure. In such copiers, the feeder apparatus does not operate unless it senses a document in the document feeder in its place and feeder in its place is in proper position for feeding document sheets. Consequently, the book or thin sheet must be manually removed after the programmed number of copies have been made. In addition, the '862 patent provides a means for inhibiting the operation of the document feeder if copies of such manually placed documents are not removed. Specifically, a flag is set each time the copier is operated when the feeder is not used and the flag disables the feeder until its carriage is manually lifted up and brought back down, which indicates to the copier logic that the user has removed the manually placed document from the exposure platen.

In such a photocopier as the KODAK® 2100 copier recirculating document feeder when used feeds the sheets or pages of the multisheet original document from the last or bottom most to the top sheet or page and the copy sheets of each page are dropped facing up into the bins of the collator so that the copies are arranged in the proper collated order.

In order to avoid reversing the copy pages in the collator when collated copies of multipaged documents or books are manually presented to the exposure platen mode, it is necessary to manually place the original document pages or sheets on the exposure platen from last to first.

A recirculating document feeder with a document positioner is also shown in U.S. Pat. Nos. 4,169,674 and 5,085,418. The recirculating document feeders deliver document sheets seriatim to the reproduction apparatus exposure station and return the sheets to the document stack in order. At the exposure station, only one reproduction of each respective document sheet is made on one circulation. The desired number of reproductions is made by recirculating the document sheets from the stack to the exposure station and then back to the stack a corresponding number of times. By such reproduction sequence, the reproduction set of the document set is received at an output hopper in collated order. Thus, no subsequent operational steps on the reproduction set are required. Moreover, the recirculating document feeder shortens the copying time when making multiple copies of multisheet original documents.

The improved recirculating document feeder of the '418 patent comprises a support for a document sheet stack with a selected side of each document sheet facing up and with the selected side of the top-most document sheet in said stack for ready viewing. A feed path extends away from and then back to the document support, for directing sheets from the support into association with the exposure station and then back to the stack, the feed path defining with the support a closed-loop that inverts a sheet and directs the sheet into association with the reproducing station selected side down and then inverts the sheet again and directs the sheet to the top of the stack selected side up.

A document positioner is also provided that operates in a fashion similar to that described above with respect to the '862 patent in that it feeds a single sheet of a multisheet document at a time into the exposure position, makes the requisite number of exposures and copies, and then transports the sheet away and deposits it in a tray. The document sheet must be placed face down and manually advanced into a slot adjacent the exposure platen. Only one original document sheet at a time may be fed manually into the document positioner, and typically, users feed the pages or sheets of the original document into the document positioner from the first to the last page. Detectors are provided in the document positioner to detect a sheet being advanced into the slot to trigger operation of the feeder. The detection of the use of the document positioner also sets a flag for the collator so as to alter the transport path in order to turn over the copy sheets and direct them face down into the collator bins. Thus, the collated copies are assembled in the bins in the proper order.

After the principal or main print job is completed, a job supplement operation may be commenced that requires the job supplement copy sheets or merged-in data bearing sheets to be assembled in the correct order with the main copy job copies remaining in the collator bins. In the job-plus operation, merged-in VIEW data constituting the job supplement job results in a plurality of copy sheets which are deposited into each bin of the collator either face up or face down on top of the copies of the principal job. The principal job may have been copied employing the recirculating document feeder and copies thereof deposited face up in the bins. Alternatively, the principal job may have been printed using the document positioner and copies thereof deposited face down in the bins. Thus, instances arise where the principal job may have been made using the recirculating feeder leaving copies face up, and the job plus copies (which might be only one page using the patch creation mode or mail addressee VIEW data) may be subsequently made using the document positioner but be positioned face down as is usual for copies from the document positioner. In order to remedy this, the aforementioned KODAK® 2100 Copier/Duplicator copier has a feature that allows all job-plus copies made using the document positioned to be placed in the bins face up. This will tend to correct most problems since the recirculating feeder is used more often than the document positioner for feeding the principal job.

However, in any such electrophotographic reproduction apparatus employing a document positioner and document recirculating feeding apparatus, it is possible that the main and supplemental print jobs will be assembled in an improper order or facing opposite directions within the bins of the collator. If this occurs, it becomes necessary to manually reposition the principal copy job and supplemental copy or print jobs, thus obviating the advantages of the sophisticated programming, copying and collating apparatus.

SUMMARY OF THE INVENTION

It is thus an object of the present invention to provide a reproduction apparatus and method of operating same which allows the assembly of a principal copying job comprising a plurality of identical copies of an original document of one or more pages with a supplemental copy and/or print job wherein the principal copy job and supplemental job are assembled in the same orientation in the bins; i.e., wherein the term "orientation" as used herein implies a condition for sheets of facing in one direction or another direction such as face-up or face down.

This and other objects of the present invention are realized in reproduction apparatus for assembling a first copy job including a plural number of identical copies of an original document of more than one page with a supplemental copy job including a like plural number of copy sheets, the apparatus comprising means for reproducing the first copy job in either a first mode wherein the copies are made of said original document last page first to first page last copy order or a second mode wherein copies are made of said original document first page first to last page last copy order, collating means for sorting copy sheets of each copied page of said original document into a like number of collating bins wherein the copy sheets are stored in collated order; copy sheet feeding means for feeding copy sheets to said collating means; controller means operable in response to commands entered by the user specifying the number of copies to be made of said original document and the selection of the first mode or the second mode for repetitively operating said copy sheet feeding means for providing said copy sheets of each page to said collating means for storage respectively in the bins in the first or second order in which the pages of said original document are reproduced; said controller means further including means responsive to selection of said first mode for said first copy job for successively making copies of information associated with a supplemental copy and/or print job on copy sheets and for successively operating said collating means for positioning said copy sheets of said supplemental copy and/or print job in a first orientation in each of said bins consistent with respect to the pages of each copy made of said original document therein and means responsive to selection of said second mode for said first copy job for successively making copies of information associated with a supplemental copy and/or print job on copy sheets and for successively operating said collating means for positioning said copy sheets in a second orientation in each of said bins consistent with respect to the pages of each copy made of said original document therein.

In accordance with another aspect of the invention there is provided a method for assembling copy sets of a first copy job including a plural number of identical copies of an original document of more than one page with a supplemental copy job including a like plural number of copy sheets, the method comprising reproducing the first copy job in either a first mode wherein the copies are made of said original document last page first to first page last copy order or a second mode wherein copies are made of said original document first page first to last page last copy order, sorting copy sheets of each copied page of said original document into a like number of collating bins wherein the copy sheets are stored in collated order; feeding copy sheets to said collating bins; in response to commands entered by the user specifying the number of copies to be made of said original document and the selection of the first mode or the second mode, repetitively operating the feeding of copy sheets for storing copy sheets respectively in the bins in the first or second order in which the pages of said original document are reproduced; in response to selection of said first mode for said first copy job successively making copies of information associated with a supplemental copy and/or print job on copy sheets and successively positioning copy sheets of said supplemental copy and/or print job in a first orientation in each of said bins consistent with respect to the pages of each copy made of said original document therein and in response to selection of said second mode for said first copy job successively making copies of information associated with a supplemental copy and/or print job on copy sheets and successively positioning said copy sheets in a second orientation in each of said bins consistent with respect to the pages of each copy made of said original document therein.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

Figure 1:
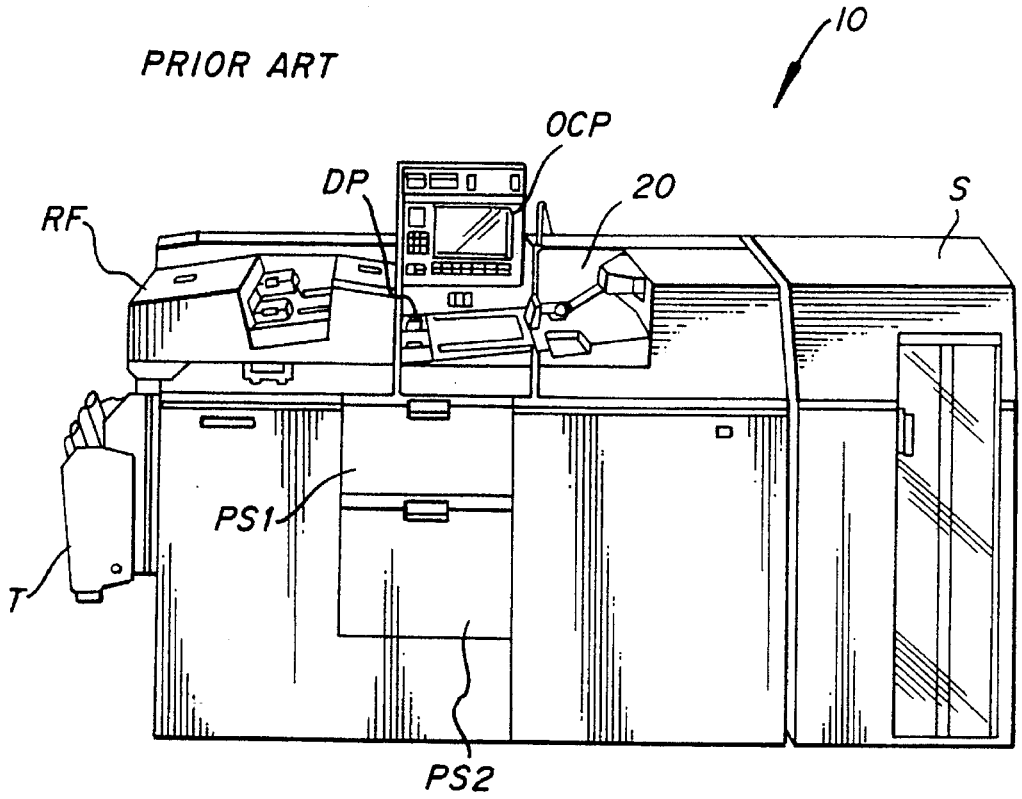
FIG. 1 PRIOR ART
FIG. 1 is a general view in perspective, of a prior art reproduction apparatus with a recirculating document feeder and document positioner in operative association therewith.
Figure 2:
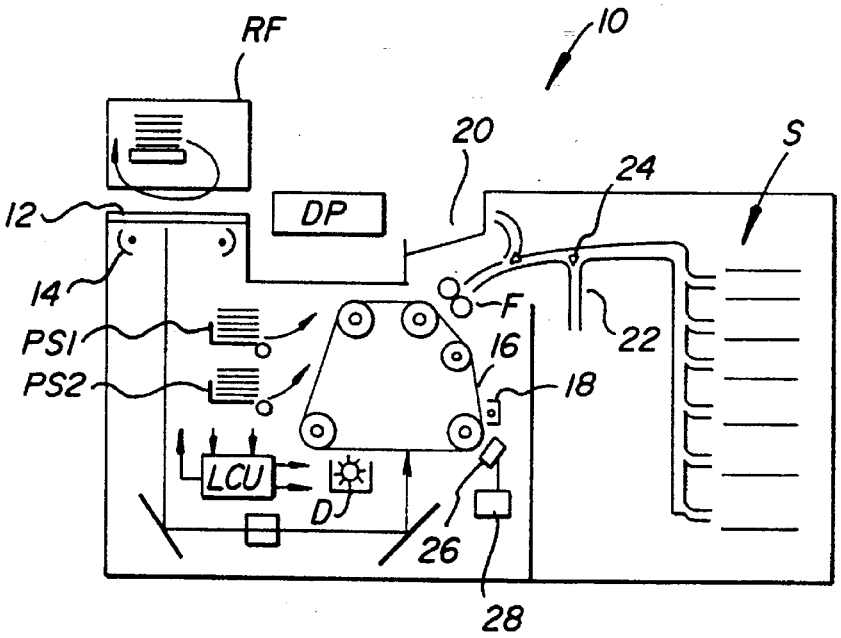
FIG. 2 is a front elevational view, in schematic form, of certain elements of the apparatus of FIG. 1.

Referring now to the accompanying drawings, FIGS. 1 and 2 show a reproduction apparatus 10 having a recirculating document feeder (RF). The reproduction apparatus may be, for example, an electrostatographic copier, thermal, or ink jet device. The requirement common for any selected typical reproduction apparatus is that it includes a reproducing station where a document sheet is received and information contained on the document sheet is extracted for reproduction by the apparatus. An example of such a reproducing station is a transparent platen or glass 12 that defines an exposure where a document sheet placed thereon is exposed by a light source 14 to obtain a reflected light image of the contained information. Additionally, the operator can select between a plurality of original document sources including but not limited to a document positioning means, DP, and a recirculating document feeder means, RF. The document positioning means provides for receiving an original document and transporting each page of the original document to the exposure position of the platen in a first order or mode and for generating a corresponding first signal. The recirculating document feeder means provides for receiving an original document and transporting each page of the original document to the exposure position of the platen in a second order or mode which is different from the first order or mode and for generating a corresponding second signal. Memory means are also provided for memorizing the first or second signals until the memory means is reset upon removal of the copy sheets from collator bins of a collator which is coupled to the reproduction apparatus. The mode or order corresponds to the order of the feeding of the pages of the document to the exposure position by the document positioning means and the recirculating feeder means. Of course, it is suitable for this invention to optically or electronically scan the document sheet in any well known manner to obtain the information for reproduction. Further, the reproduction apparatus includes an electronically based control system, or the like, such as a microprocessor based logic and control unit (LCU), which communicates in any manner well understood in the art with the recirculating document feeder and other operational parts of the apparatus to operate the feeder and control such operation in coordinated synchronism with the reproduction apparatus.

Programming of commercially available microprocessors is a conventional skill well understood in the art. This disclosure is written to enable a programmer having ordinary skill in the art to produce an appropriate control program for the one or more microprocessors used in this apparatus. The particular details of any such program would, of course, depend on the architecture of the designated microprocessor.

In addition to controlling the recirculating feeder the LCU controls operation of the document positioner which includes various known feed mechanisms for feeding a sheet placed adjacent a slot opening between the recirculating feeder housing and the platen. The documents positioned one by one into the document positioner feeder are fed to the platen and exposed. Where collation mode is selected and where N copies are requested by the operator through inputs provided using buttons and the display on the operator control panel (OCP), each document is exposed N times. Exposure of each original document sheet causes an image thereof to be projected through reflection by mirrors and imaging optics onto a photoconductive belt 16 that is uniformly electrostatically by corona charger 18. The exposure of the belt to the image causes a latent electrostatic image to form which is developed with an opaque toner at developer station D. This toned image is then transferred to a plane paper receiver sheet from one of two or more paper supplies PS1, PS2 which is selected by the operator. The toned image is transferred to the receiver sheet by suitable known means (not shown) and then fed through into fuser F to fuse the image to the receiver sheet. The receiver sheet, now a copy sheet, is either fed to a top tray 20 or where sorter collation is to be made the sheet is fed to sorter S. In the sorter there are provided a series of vertically arranged bins and controls are provided for directing the copy sheet to one of these bins. Thus as N copies of a first sheet are made the copies are each distributed to one of the bins so that each copy of the same document sheet gets distributed to a different bin.

As discussed above, copying by use of the recirculating feeder is expected to produce a different order to the generation of copy sheets than provided by copying using the document positioner or through manual placement on the platen glass by the operator. To accommodate this difference and to insure that the copies are deposited in each bin in the correct order for collation a turn over device 22 is provided whereby a diverter 24 directs a copy sheet downwardly to the turnover and then the sheet is fed back up to the sorter, in inverted fashion. In this way copies made using the recirculating feeder can be inverted and then deposited face-up in the sorter. After at least N exposures are made of each document sheet the document sheet is fed to a collecting tray, T, if made using the document positioner. If made using the recirculating feeder the document sheet is fed to the top of the document sheet stack in the recirculating feeder. Manual presented copies are removed manually and the next document sheet presented. It is noted that for making N copies (N>1) that "at least" N exposures are made because in certain copiers a first exposure may be used as a cleaning exposure to clean a leading interframe area and this exposure is not developed.

In addition to imaging using an optical exposure the copier may be provided with an LED printhead 26 or other electro-optical or electronic image exposure source. The electronic exposure source may receive electronic data from a source 28 such as a floppy disk drive or be connected to other known internal or external sources of image data. This source may be used for printing on or more pages of data or used merely to annotate a document that is optically copied.

The feature of job-plus or a supplemental job is a well known one and is set-up via inputs provided by the operator to the OCP or from a remote terminal if this connection is so provided. Therefore, a detailed description of the job-plus function need not be provided but it should be understood that this job-plus function typically comes within or after a current job. In known copiers the status of the details of operation of the last job are not stored in usable memory except perhaps for billing purposes and as a job is completed the apparatus is reset to programmed default operation status which status is then changed as the job-plus job is entered by the operator.

Figure 3A:
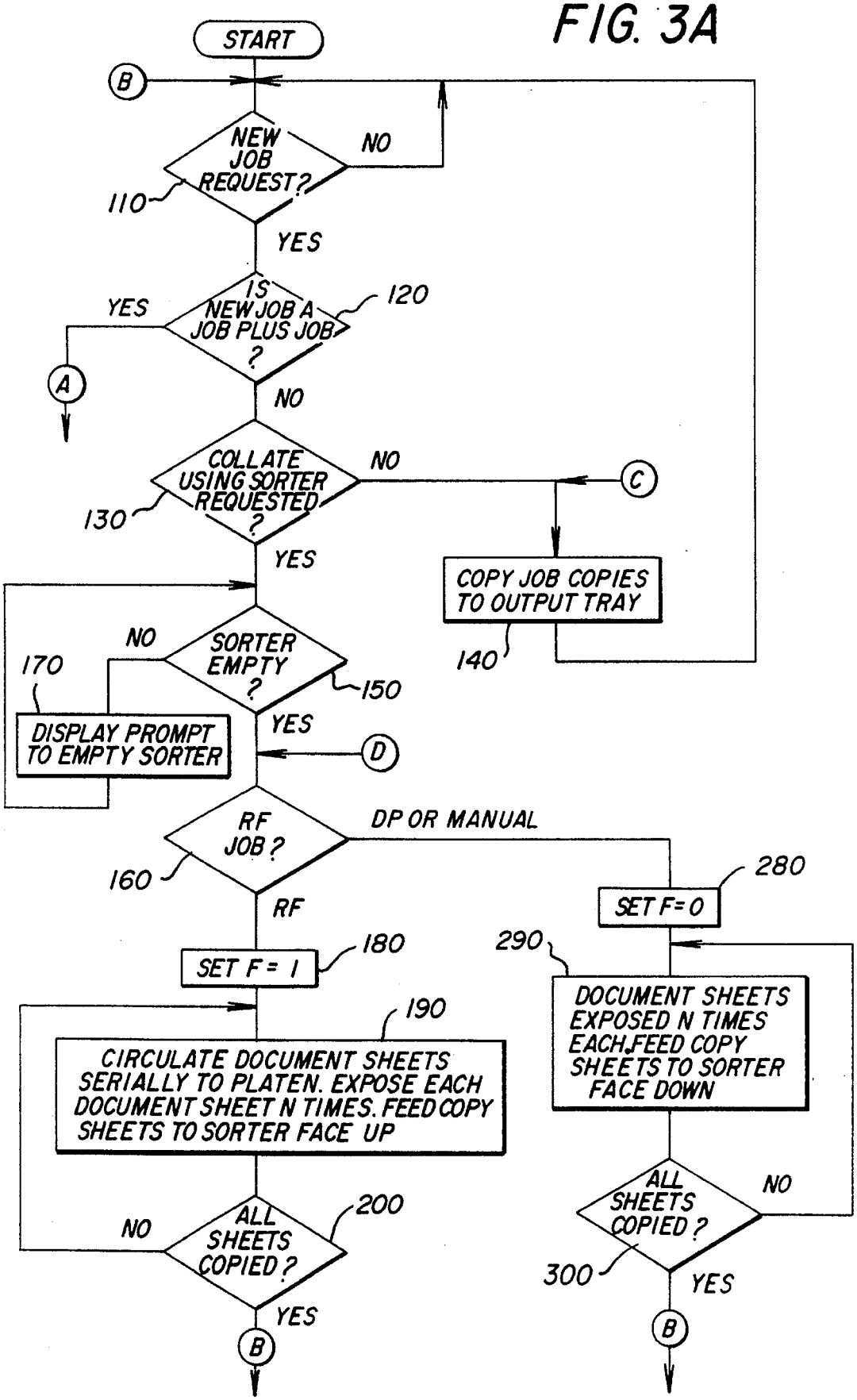
FIGS. 3A and 3B comprise a simplified flowchart of a method of operation in accordance with the invention of the job-plus function with collated copies made with either the document positioner or the recirculating document feeder.
Figure 3B:
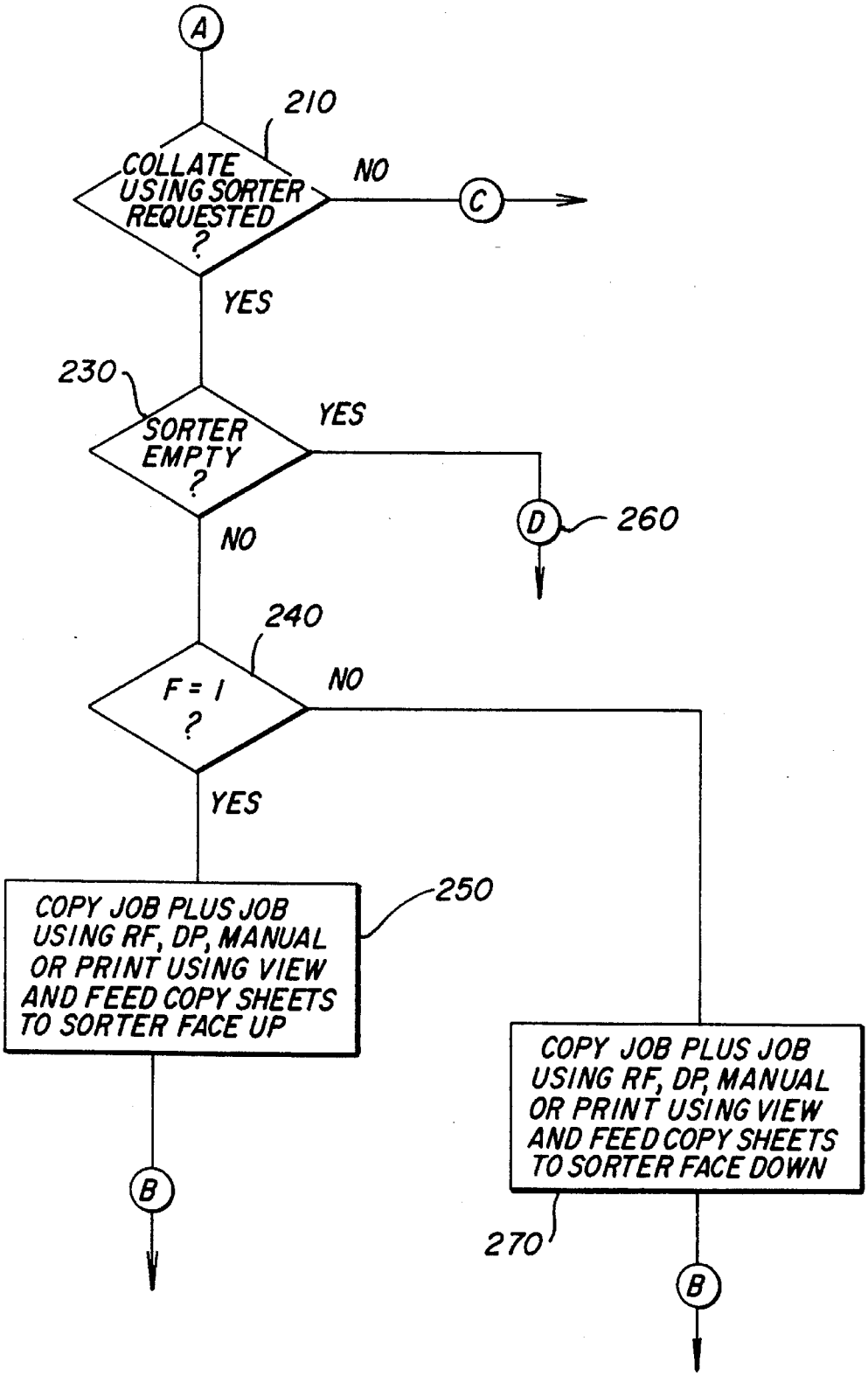

With reference now to the flowchart of FIGS. 3A and 3B, in step 110 the copier's logic and control unit analyzes the inputs for a new job request and distinguishes between an ordinary new job request and a job-plus new job request which is selectable by the operator from a special feature selection option provided by the copier's display panel. Assume in step 120 that the new job request is not for job-plus. In step 130, a determination is made as to whether or not collation using the sorter is requested. Recall from above that a settable default option typically provides for selection of the output tray for copies. If collation using the sorter is not selected, the copy job is processed and completed and the copies sent to the output tray, step 140. However, if collation using the sorter is requested, and the job is to be copying of documents placed in the recirculating feeder RF as sensed by sensors in the feeder, step 160, then a determination is made as to whether or not the sorter is empty, step 150. If the answer is no, the copier is programmed to inhibit the copying operation and display on the OCP's display panel a prompt to the operator that the sorter needs to be emptied, step 170. Alternatively, the copier may process the new job and have the documents stored in the sorter on top of the previous job in a job-plus manner to be described. If the sorter is empty, a flag is set (F=1) in the LCU, step 180, and the document sheets to be copied for this new job request are serially circulated to the platen. At the platen at least N exposures of each document sheet is made where N is the number of copies requested which has an upper limit on the number of sorter bins available. Copy sheets are fed to the sorter face up, step 190, since in making copies from the recirculating feeder the copies are made, last sheet first. This requires inverting of copies after being fused. After all document sheets in this job are copied, and sent to the sorter, step 200, the job is over and the copier's logic is set to receive input for a new job request, step 110. If a flag is not set (F=0) in the LCU, step 280, the document sheets are each exposed N times wherein N is the number of copies requested. The copy sheets are then fed to the sorter face down, step 290. In step 300, it is determined if all the document sheets have been copied. If so, the job is over and the copier's logic is set to receive input for a new job request at step 110. If it is determined in step 300 that all of the document sheets have not been copied, the copier returns to step 290 until all the document sheets have been copied. If this new job request is determined to be a job-plus job in step 120 and collation using the sorter is requested, step 210, and the sorter is not empty, step 230, then the status of the flag is investigated in step 240. If its status is determined to be a flag set condition, this implies that the copies in the sorter are facing up because they are copies of a job made using the recirculating feeder. The job-plus job, comprising one or more originals, may require copying using document sheets present either in the recirculating feeder or provided by the document positioner, or manually placed on the platen glass or printed using VIEW, i.e. the electro-optical writer. The requested number of copies from this job-plus job are output to the sorter face up, step 250. In a typical job-plus job, a single page is desired to be copied N times and the N copies sent to the sorter and sorted accordingly on top of the previous job present in the sorter. Where more than one original is provided, N copies are made and sorted before copying of the copies in the sorter bins from the previous job. The program may be adjusted to allow a job-plus job to be processed within a job through interruption of the current job. In step 230, if the sorter is determined to be empty a display prompt may be provided to indicate that job-plus jobs to an empty sorter are not recognized as valid or alternatively, the copier may be programmed to allow such to be copied as a normal job request, step 260. If in step 240, the flag is determined not to be set, the job-plus job is copied using either the recirculating feeder, the document positioner, manual placement on the glass or printed using VIEW. In step 270, the copies made are sent to the sorter face down to be consistent with the orientation of the document sheets in the sorter.

There is thus provided an improved apparatus and method for producing of collated copy sets of supplement jobs.

The invention has been described in detail with particular reference to preferred embodiments thereof and illustrative examples, but it will be understood that variations and modifications can be effected within the spirit and scope of the invention.

What is claimed is:

1. Reproduction apparatus for assembling a first copy job comprising a plurality of identical copies of an original document of more than one page with a supplemental print job comprising a like plurality of variable information copy sheets bearing unique information, the apparatus comprising:

a photosensitive member;

charging means for charging said photosensitive member;

an exposure platen for receiving the pages of said original document in an exposure position;

document positioning means selectable by the user for receiving said original document and transporting each page of said original document to said exposure position of said platen in a first order and for generating a first signal when selected;

document recirculating feeder means selectable by the user for receiving said original document and transporting each page of said original document to said exposure position of said platen in a second order that is different from said first order and for generating a second signal when selected;

imaging means for exposing each page of said original document in said exposure position as a latent image onto said charged photosensitive member;

developing means for developing said latent image on said charged photosensitive member to form a toner image thereon;

transferring means for transferring said toner image formed by said developing means onto a copy sheet and fixing a copy of the page of the original document thereon;

collating means for sorting said copy sheets of each copied page of said original document into a like number of collating bins wherein the copy sheets are stored in collated order;

copy sheet feeding means for feeding copy sheets through said transferring means and to said collating means;

controller means operable in response to commands entered by the user specifying the number of copies to be made of said original document and the selection of the document positioning means or the recirculating feeder means for repetitively operating said imaging, developing, and transferring means for making a like number of copies of each page of the original document on a like number of copy sheets and for repetitively operating said copy sheet feeding means for providing said copy sheets of each page to said collating means for storage respectively in the bins in the first or second order in which the pages of said original document are copied;

memory means for memorizing said first or second signals until said memory means are reset upon removal of said copy sheets from said collating bins;

further image exposure means for exposing said charged photosensitive member with variable image information unique to each of said plurality of copies; and wherein said controller means further comprises;

first means responsive to said first signal for repetitively operating said further image exposure means and said developing, transferring, and copy sheet feeding means to successively make copies of said unique information on copy sheets during a supplemental print job and for successively operating said collating means for positioning said unique information bearing copy sheets in a first orientation in each of said bins consistent with respect to the pages of each copy made of said original document therein; and second means responsive to said second signal for repetitively operating said further image exposure means and said developing, transferring, and copy sheet feeding means to successively make copies of said unique information on copy sheets during a supplemental print job and for successively operating said collating means for positioning said unique information bearing copy sheets in a second orientation in each of said bins consistent with respect to the pages of each copy made of said original document therein.

2. Reproduction apparatus for assembling a first copy job comprising a plural number of identical copies of an original document of more than one page with a supplemental copy or print job comprising a like plural number of copy sheets, the apparatus comprising:

a photosensitive member;

an exposure station for receiving the pages of said original document in a exposure position for copying;

first means for presenting each page of said original document to said exposure station for copying in a first mode having a first order for copying of said pages and for generating a first signal indicating that copying is in said first mode;

second means for presenting each page of said original document to said exposure station for copying in a second mode having a second order for copying of said pages that is different from said first order and for generating a second signal indicating that copying is in said second mode;

means for forming a latent image of each page of said original document onto said photosensitive member;

developing means for developing said latent image on said charged photosensitive member to form a toner image thereon;

transferring means for transferring said toner image formed by said developing means onto a copy sheet and fixing a copy of the page of the original document thereon;

collating means for sorting said copy sheets of each copied page of said original document into a like number of collating bins wherein the copy sheets are stored in collated order;

copy sheet feeding means for feeding copy sheets through said transferring means and to said collating means;

controller means operable in response to commands entered by the user specifying the number of copies to be made of said original document and the selection of the first or second means for repetitively operating said imaging, developing, and transferring means for making a like number of copies of each page of the original document on a like number of copy sheets and for repetitively operating said copy sheet feeding means for providing said copy sheets of each page to said collating means for storage respectively in the bins in the first or second order in which the pages of said original document are copied;

memory means for memorizing said first or second signals until said memory means are reset;

means for inputting a supplemental copy or print job request; and wherein said controller means further comprises:

means responsive to said first signal for successively making copies of information associated with the supplemental copy or print job on copy sheets and for successively operating said collating means for positioning of said supplemental copy or print job in a first orientation in each of said bins consistent with respect to the pages of each copy made of said original document therein; and means responsive to said second signal for successively making copies of information associated with the supplemental copy or print job on copy sheets and for successively operating said collating means for positioning said copy sheets of said supplemental copy or print job in a second orientation in each of said bins consistent with respect to the pages of each copy made of said original document therein.

3. Reproduction apparatus for assembling a first copy job including a plural number of identical copies of an original document of more than one page with a supplemental copy job including a like plural number of copy sheets, the apparatus comprising:

means for reproducing the first copy job in either a first mode wherein the copies are made of said original document last page first to first page last copy order or a second mode wherein copies are made of said original document first page first to last page last copy order, collating means for sorting copy sheets of each copied page of said original document into a like number of collating bins wherein the copy sheets are stored in collated order;

copy sheet feeding means for feeding copy sheets to said collating means;

controller means operable in response to commands entered by the user specifying the number of copies to be made of said original document and the selection of the first mode or the second mode for repetitively operating said copy sheet feeding means for providing said copy sheets of each page to said collating means for storage respectively in the bins in the first or second order in which the pages of said original document are reproduced;

said controller means further including means responsive to selection of said first mode for said first copy job for successively making copies of information associated with a supplemental copy and/or print job on copy sheets and for successively operating said collating means for positioning said copy sheets of said supplemental copy and/or print job in a first orientation in each of said bins consistent with respect to the pages of each copy made of said original document therein and means responsive to selection of said second mode for said first copy job for successively making copies of information associated with a supplemental copy and/or print job on copy sheets and for successively operating said collating means for positioning said copy sheets in a second orientation in each of said bins consistent with respect to the pages of each copy made of said original document therein.

4. The apparatus of claim 3 and wherein said feeding means includes a turn over device for changing the orientation of sheets fed to said collating means so as to change the orientation of said copy sheets.

5. A method for assembling copy sets of a first copy job including a plural number of identical copies of an original document of more than one page with a supplemental copy job including a like plural number of copy sheets, the method comprising:

reproducing the first copy job in either a first mode wherein the copies are made of said original document last page first to first page last copy order or a second mode wherein copies are made of said original document first page first to last page last copy order, sorting copy sheets of each copied page of said original document into a like number of collating bins wherein the copy sheets are stored in collated order;

feeding copy sheets to said collating bins;

in response to commands entered by the user specifying the number of copies to be made of said original document and the selection of the first mode or the second mode, repetitively operating the feeding of copy sheets for storing copy sheets respectively in the bins in the first or second order in which the pages of said original document are reproduced;

in response to selection of said first mode for said first copy job successively making copies of information associated with a supplemental copy and/or print job on copy sheets and successively positioning copy sheets of said supplemental copy and/or print job in a first orientation in each of said bins consistent with respect to the pages of each copy made of said original document therein and in response to selection of said second mode for said first copy job successively making copies of information associated with a supplemental copy and/or print job on copy sheets and successively positioning said copy sheets in a second orientation in each of said bins consistent with respect to the pages of each copy made of said original document therein.

6. The method of claim 5 and wherein in said sorting step copies of said first copy job in said first mode are stored in a face-up orientation.

7. The method of claim 6 and wherein in said reproducing step said original document is fed to an exposure station for copying by a recirculating feeder for copies made in said first mode.

8. The method of claim 6 and wherein in said sorting step copies of said first copy job in said second mode are stored in a face-down orientation.

9. The method of claim 8 and wherein said supplemental copy job includes a copy with unique information so that each assembled copy set of a first copy job and supplemental copy job in a bin includes a page with respective unique information not provided on other copy sets stored in other copy bins.

* * * * *